United States Patent [19]

Grondin et al.

[11] 4,301,602

[45] Nov. 24, 1981

[54] APPARATUS FOR TREATING A MOVING WEB

[75] Inventors: Edward A. Grondin; Lawrence R. Tulloch; Martin P. Perkins, Jr., all of Greenville; Alexander P. Krstovic, Easley; Bryon W. McCoy, Taylors; Kevin P. Morey, Easley, all of S.C.

[73] Assignee: Fintex, Inc., Greenville, S.C.

[21] Appl. No.: 223,566

[22] Filed: Jan. 8, 1981

Related U.S. Application Data

[63] Continuation of Ser. No. 28,181, Apr. 9, 1979, abandoned.

[51] Int. Cl.[3] ..... F26B 13/30; F26B 21/06

[52] U.S. Cl. ..... 34/43; 34/160; 15/307; 250/560

[58] Field of Search ..... 34/92, 43, 160, 158; 15/307; 162/374; 250/560

[56] References Cited

U.S. PATENT DOCUMENTS

| | | | |
|---|---|---|---|
| 1,576,679 | 3/1926 | Smith | 15/307 |
| 1,759,804 | 5/1930 | Pieron | 15/307 |
| 2,164,174 | 6/1939 | Gerard et al. | 15/307 |
| 2,792,587 | 5/1957 | Rose et al. | 34/160 |
| 2,810,316 | 10/1957 | Snyder | 250/560 |
| 3,836,428 | 9/1974 | McConaugay | 162/366 |

*Primary Examiner*—Larry I. Schwartz

*Attorney, Agent, or Firm*—Bailey, Dority & Flint

[57] ABSTRACT

Apparatus for extracting liquid from a moving web having reduced suction requirements, conserving space and being more servicable may be provided through the use of an upper wear surface constructed of ultra high molecular weight polyethylene having a transverse slot therein over which the web passes, together with elongated transverse inserts for blocking end portions of the slot responsive to movement of the web from side to side as it drifts or wanders during its movement over the slot.

8 Claims, 5 Drawing Figures

APPARATUS FOR TREATING A MOVING WEB

This is a continuation of application Ser. No. 28,181, filed Apr. 9, 1979, now abandoned.

BACKGROUND OF THE INVENTION

Suction boxes and the like have long been in use, especially in the textile industry, for extracting liquid as from a moving web. The prior art includes U.S. Pat. No. 3,836,428 which illustrates the use of polyethylene material and means for varying the widths of slots which includes top wear surfaces in the form of replaceable strips. Applicant's invention on the other hand, is concerned with the provision of means for reducing suction requirements through varying the effective length of slot to accommodate the web. Since the fabric passing over a suction slot typically wanders or drifts from side to side in the course of such passage, and since it is necessary that suction be applied across the entire width of the fabric, the slot must be of greater length than that of the cloth to accommodate such wandering.

The prior art also contemplates a blocking means for varying the effective length of a suction slot wherein a strip is unrolled to cover end portions of the slot, however, the rolling and unrolling of the blocking strip is difficult and ineffective in practice.

Accordingly, it is an important object of this invention to provide inserts moved in and out adjacent end portions of the slot generally following movement of the web from side to side so as to cover portions of the slot which are exposed by such movement. By thus blocking uncovered portions of the slot, the amount of suction necessary to remove a given quantity of liquid from the web is minimized. It is also possible in accordance with the invention, to easily accommodate various widths of cloth for use on the apparatus.

Another important object of the invention is to provide an improved suction slot with blocking means to vary the effective length thereof by moving in and out and being constructed of ultra high molecular weight polyethylene so that the Durometer hardness of the insert is less than that of the wear surface.

Another important object of the invention is the provision of apparatus for treating a web wherein tracking means are provided for following the side to side movements of the web which include inner and outer sensing means positioned on each side of the web which move responsive to movement of the web. Such sensing means also move the blocking means hereof.

SUMMARY OF THE INVENTION

It has been found that the suction requirements of a suction slot for extracting liquid from a longitudinally moving web and the like may be reduced by moving blocking means in and out with respect to end portions of the slot simultaneously with sensing means on each side of the fabric and responsive to the drifting motion of the web as it passes over the slot. Wear characteristics may be improved by making the upper wear surface of the slot from ultra high molecular weight polyethylene and blocking inserts for the ends of high molecular weight polyethylene which is less wear resistant so as to make it possible to replace the less expensive insert rather than the more basic expensive elements from which the slot assembly is constructed. By providing inner and outer sensing elements on each side of the web and making provision for moving the sensing elements on each side of the web independently in and out responsive to movements of the cloth, it is possible to also move the blocking inserts simultaneously therewith in and out of the end portions of the slot to vary its effective length.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The drawings illustrate apparatus having an elongated transverse suction slot for extracting liquid from a longitudinally moving web. An upper wear surface A has a transverse opening therein defining the slot over which the web W passes. Elongated transverse inserts B block end portions of the slot and means C move the inserts transversely in and out responsive to movement of the web from side to side in its passage over the slot. An end portion of the slot uncovered by movement of the web, may thus be blocked to reduce suction required. Apparatus for sensing the lateral movements of a moving web and the like include an inner source and detector assembly D carried adjacent opposed sides of the web. An outer source and detector assembly E is carried outwardly of each inner source and detector assembly. A pair of trolleys F are each carried on an opposite side of the web move inwardly and outwardly of said web responsive to the detectors.

Figure 2:
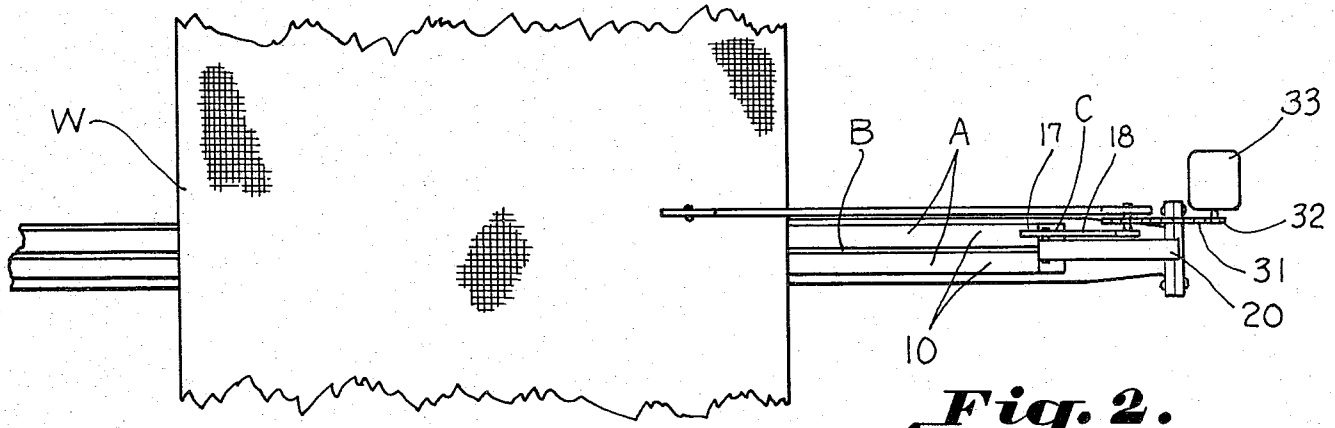
FIG. 2 is a top plan view, with parts omitted, further illustrating the suction slot with a web passing thereover with drive means for inserting the blocking strips.
Figure 3:
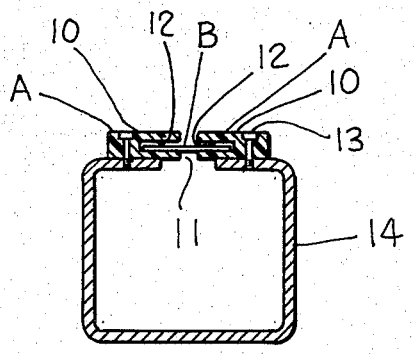
FIG. 3 is a transverse sectional elevation taken on the line 3—3 in FIG. 1.
Figure 4:
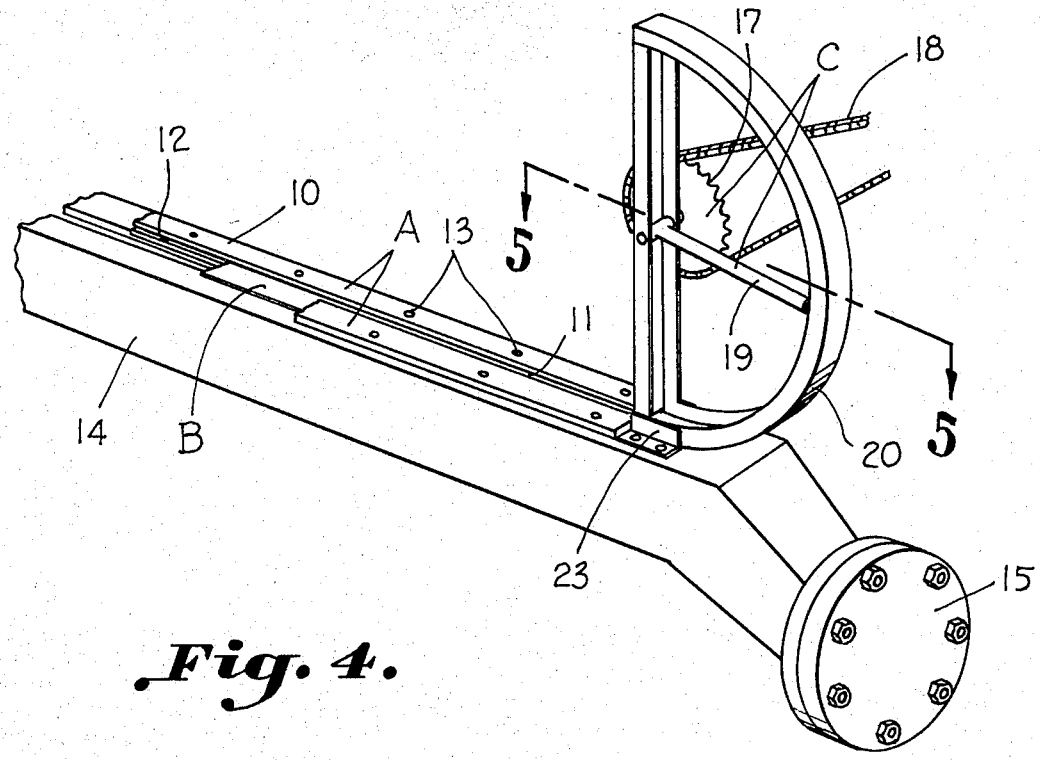
FIG. 4 is a front perspective view looking toward an end of the suction slot from the opposite side of FIG. 1.

The upper wear surface A is formed in spaced slot face portions 10 (FIGS. 2 and 3) which define an opening or slot 11 therebetween. Each of the face portions are illustrated as having an opposed groove 12 machined therein to accommodate the elongated inserts B positioned transversely with respect to the web W. The spaced face portions 10 are secured by suitable fastening means such as spaced bolts 13 to an upper surface of a suction box or plenum 14. The plenum illustrated here in the form of an enlarged pipe is closed at ends as illustrated at 15 and a source of suction is illustrated as being provided in any suitable fashion, as in the form of a centrally communicating suction line 16. The web which is illustrated in the form of a foraminous material, such as woven or non-woven fabric, passes over the upper wear surface A and a portion of the liquid carried therein is drawn through the suction slot to be thus directed away from the fabric reducing its moisture content.

Figure 1:
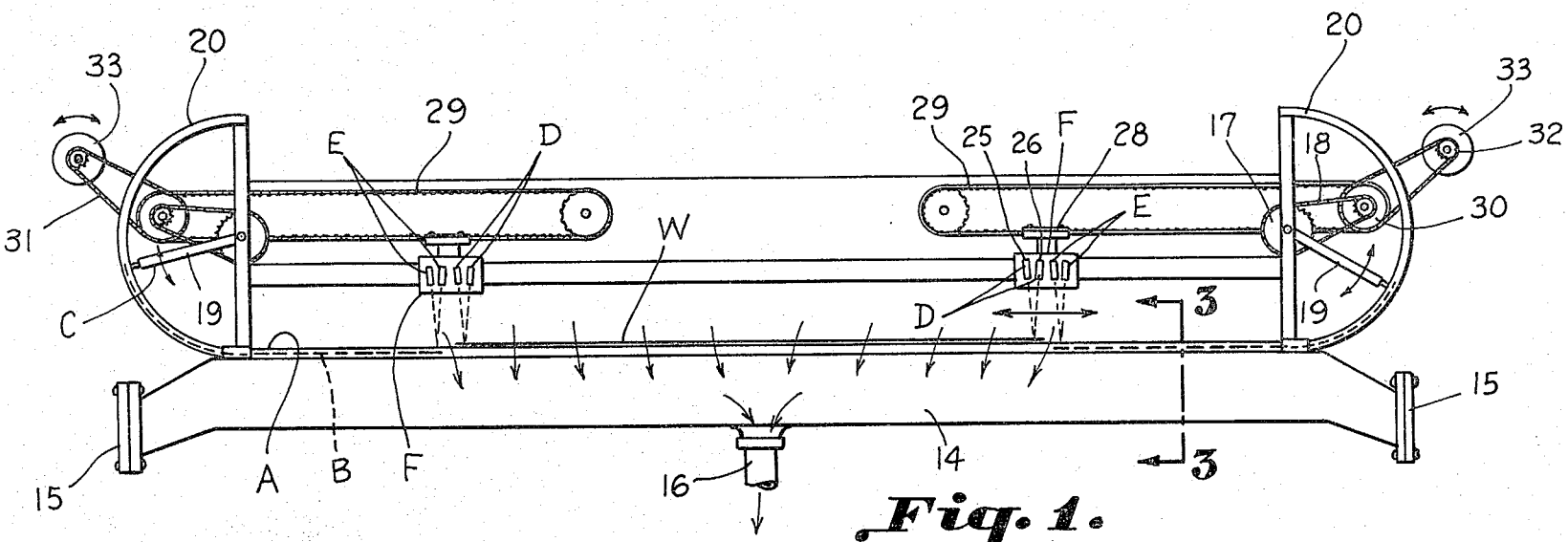
FIG. 1 is a schematic longitudinal elevation illustrating a suction slot carried transversely of a moving web passing thereacross (into the paper) together with tracking means for the cloth and guide means for inserting blocking strips varying the effective length of the slot responsive to cloth movement.
Figure 5:
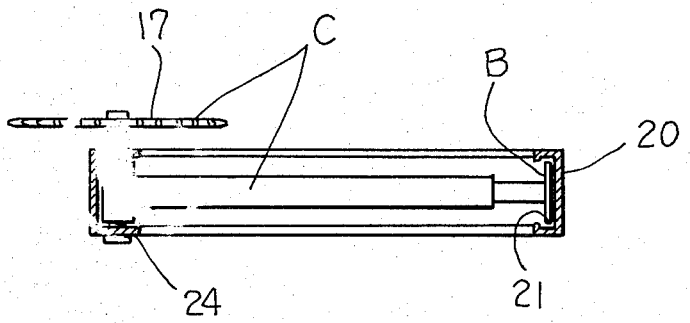
FIG. 5 is a sectional plan view taken on the line 5—5 in FIG. 4 illustrating the guide means and power operated means for moving the strip in and out with respect to an end portion of the suction slot.

The means C for moving the inserts transversely in and out with respect to the slot are illustrated as including a gear 17 driven as by a belt 18. An arm 19 is connected to an elongated flexible strip which forms the transverse inserts B. The strip is contained within arcuate guide means 20 which has an internal slot 21 therein (FIG. 5). The guide 20 is positioned by suitable bracket means 23 upon an upper portion of the pipe 14 adjacent each end thereof. The arm 19 is supported for pivotal movement within the bracket 24. Inner source and detector assemblies D each include an inner sensing element carried adjacent opposed sides of the web. The source illustrated schematically at 25 may be in the form of a light source or a source of infrared radiation, as may reflect from the web passing over the slot. The detector is schematically illustrated as at 26 (FIG. 1) and may be in the form of a photoelectric cell. Similar source and detector means form an outer assembly E positioned outwardly of the inner assemblies D on each side of the web. A pair of trolleys F carry inner and outer assemblies D and E, respectively, for independent movement in and out on each side of the web F and are positioned for sliding movement on a rail 27. The trolleys are driven through a suitable connection 28 which is carried as upon a timing belt 29 which is driven by a sprocket 30 through a belt 31 from a power output sprocket 32, driven by the synchronous motor 33 so as to supply a synchronous drive for causing the movement of the insert to follow the movement of the cloth. The trolleys carry the assemblies D and E for movement in and out to accommodate webs of various widths and to provide for movement of the blocking inserts for the slots simultaneously therewith responsive to movement of the cloth as it oscillates during its passage across the suction slot.

Accordingly, an important advantage of the present invention is derived from the construction of the slot face of ultra high molecular weight polyethylene, together with the provision of the insert constructed of similar material but of softer material so that it will wear before the slot face. The slot face may be made of virgin material whereas the insert may be made from reprocessed ultra high molecular weight polyethylene thus causing the wear to occur on the roll easily replaceable and less expensive insert. Space is conserved through the provision of the arcuate guiding track which facilitates the insertion of the flexible strip through the use of a radial arm drive so that the blocking strip may be moved in and out of the milled section or groove of the slot face member. Since the slot face and the insert possess the properties of lubricity when wet, the wear characteristics and operating characteristics for accommodating the web are facilitated with less wear and less friction during the operation of both.

For example, a slot may be provided that is 80 inches long and assuming that a continuous web of foraminous material or fabric which is 60 inches wide is passed thereover at a running speed of 30 yards per minute, the cloth will drift from side to side plus or minus 3 inches. If the unnecessary portion of the slot is covered, an opening 67 inches long will remain. In order to achieve a sufficient degree of vacuum, a vacuum of between 11 inches to 13 inches of mercury must be attained. With 7 inches of open slot, a relatively large quantity of air will pass around the web taking the path of least resistance into the slot. Thus, it is desirable to close up the unnecessary 5 inches to 6 inches of slot length so that the horsepower requirements can be reduced. This is an important consideration since such units generally run day and night. By utilizing the structure outlined above, it is possible to thus desirably close the unnecessary 5 inches to 6 inches of slot length. The fabric edge sensing system described above utilizes for example, two light sources and two detectors per side. One set, source and detector, inside on each side will cause the respective trolley on which the sources and detectors are mounted to move inwardly toward the center until meeting the fabric edge. When the edge of the fabric is met, the trolley will stop because the light from the source will return to be received by the detector.

The second set of source and detector assemblies mounted outside of the first set will detect the fabric edge as it wanders toward the outside of the vacuum slot. When activated, the respective trolleys will move in the opposite direction until the light source cannot be detected because the fabric is no longer reflecting light or radiation. Thus, various widths of web elements may be accommodated. Both inner and outer sensing assemblies will compensate for the natural wandering from side to side as the web passes over the slot. The synchronous motor may utilize a chain and sprocket drive for driving the blocking insert, whereas a gear and timing belt or other element which does not slip may be utilized as a drive for the trolley. Thus, the trolley and insert will be moved simultaneously to either close or open the slot to coincide generally with the movement of the web edge. Thus, the slot length is maintained on the same order as the width of the fabric being treated.

While a preferred embodiment of the invention has been described using specific terms, such description is for illustrative purposes only, and it is to be understood that changes and variations may be made without departing from the spirit or scope of the following claims.

What is claimed is:

1. Apparatus having an elongated transverse suction slot for extracting liquid from a longitudinally moving web comprising:

an upper surface having a transverse opening therein defining said slot over which said web passes;

a transverse groove in each end portion of said slot;

an elongated transverse insert in said groove in each end portion of said slot blocking an end portion of said slot;

means extending outside the end of each end portion of said slot moving said insert transversely in and out responsive to movement of the web from side to side in its passage over said slot;

whereby an end portion of said slot uncovered by said movement of the web may be blocked to reduce suction required.

2. The structure set forth in claim 1 wherein said upper surface and said insert are constructed of ultra high molecular weight polyethylene, an oscillatable arcuate guide receiving a portion of said insert opposite said slot, and means oscillating said guide responsive to said movement of the web.

3. An elongated suction slot for extracting liquid across a moving web passing thereover comprising:

spaced slot face portions constructed of ultra high molecular polyethylene defining an upper slotted wear surface;

a groove extending along said slot face portions;

a blocking strip carried for insertion along said groove for varying the effective length of said suction slot; and means carried outside end portions of said slot moving said strip in and out of said groove.

4. The structure set forth in claim 3 wherein said strip is constructed of ultra high molecular weight polyethylene having a Durometer hardness less than that of said slot face portions.

5. The structure set forth in claim 3 including an arcuate guide receiving a portion of said strip opposite that portion received in said groove.

6. The structure set forth in claims 3, 4, or 5 including means monitoring the position of said web passing over said suction slot, and a motor operated responsive to said monitoring means for moving said strip along said groove.

7. Apparatus having an elongated transverse suction slot for extracting liquid from a web moving longitudinally thereacross comprising:

an upper surface having a transverse opening therein defining said slot over which said web passes;

an elongated transverse blocking means closing each end portion of said slot outside said web;

an electrically operated sensing means carried adjacent each side of said web;

a trolley means carried on each side of said web supporting respective electrically operated light source sensing means actuated responsive to side-to-side movement of said web during passage across said slot;

synchronous motor driven means moving respective trolleys in and out in respect to respective sides of said web responsive to said sensing means; and endless positive timing means moved by said motor activen means simultaneously with said trolleys moving said blocking means in and out in respect to respective sides of said web;

whereby said blocking means is positively positioned with said sensing means to control the opening and closing of said slot on each side of said web as the web moves from side-to-side during processing.

8. The structure set forth in claim 7 wherein said sensing includes an inner source and detector carried adjacent opposed sides of said web; and an outer source and detector carried outwardly of each of said inner source and detector.

* * * * *